United States Patent [19]

Gilbreath

[11] 3,949,347

[45] Apr. 6, 1976

[54] SWITCHING POTENTIOMETER CONTROL UNIT

[75] Inventor: Benjamin F. Gilbreath, Richardson, Tex.

[73] Assignee: Hunt Electronics Co., Dallas, Tex.

[22] Filed: Apr. 25, 1975

[21] Appl. No.: 571,575

[52] U.S. Cl. ..... 338/172; 200/156; 200/153 LA; 338/173; 338/191; 338/200; 338/202

[51] Int. Cl.[2] ..... H01C 5/02

[58] Field of Search ..... 338/118, 137, 167, 171, 338/172, 191, 198–202; 200/6 B, 156, 164, 153 LA

[56] References Cited

UNITED STATES PATENTS

| | | | |
|---|---|---|---|
| 2,836,686 | 5/1958 | Barden et al. | 338/172 X |
| 2,836,691 | 5/1958 | Girolamo et al. | 338/172 |
| 2,844,676 | 7/1958 | Barden et al. | 338/172 X |
| 2,999,991 | 9/1961 | Bender | 338/172 X |

*Primary Examiner*—C. L. Albritton
*Attorney, Agent, or Firm*—Giles C. Clegg, Jr.

[57] ABSTRACT

A control unit, for example, a light dimming unit for controlling the intensity of brightness of a lamp load connected in series with the unit, includes a switching potentiometer for serially connecting the unit between a supply line and the load and for selectively adjusting the current delivered to the load. The switching potentiometer in the unit includes a shaft mounted for both rectilinear and rotary movement. The shaft is normally urged by a spring in a first axial direction, to urge a wiper mounted on the shaft resiliently into electrical contact with a resistive strip. A ratchet means carried on one end of the shaft actuates a snap-action switch which includes an armature, movable between first and second stable positions by the ratchet means when the shaft is moved in a second opposite axial direction to disengage the wiper from the resistive strip. This establishes a maximum controlling resistance in the unit just prior to each switching operation to prevent current surges through the unit and the load and minimizes arching at the switch contacts and the wiper, resulting in longer unit life as well as extended load life. The ratchet means is provided with camming surfaces which cooperate with the armature to provide a self-cocking or reset capability for setting the ratchet prior to each actuation.

13 Claims, 20 Drawing Figures

SWITCHING POTENTIOMETER CONTROL UNIT

BACKGROUND OF THE INVENTION

1. Field of the Invention

The present invention relates to control units and, more particularly, to switching potentiometer current control units.

2. Technical Considerations and Prior Art

Current control units, for example, light dimming units for controlling the brightness or intensity of a lamp load connected in series with the unit across a supply line, commonly include switching potentiometers which perform two functions. The switching portion of the switching potentiometer connects the dimmer unit to the supply of line voltage while the potentiometer portion of the switching potentiometer provides control of the current to the lamp load, for example, through an a.c. phase control circuit.

There are basically two types of switching potentiometers commercially available. These may be classified as the rotary type and the push-button type. Push-button type switching potentiometers may employ either push-pull or push-push (reciprocating) switches and account for the majority of sales of dimmer units since they permit the unit to be switched on by pushing (push-pull) or pushing and releasing (push-push) a resistance control knob and rotating the control knob until the desired level of brightness is obtained. Once a desired level of brightness has been selected the unit may be turned off simply by actuating the control knob by pulling it outwardly (push-pull) or by pushing and releasing it (push-push). Thereafter the desired brightness setting can be provided without any need for readjustment.

The principal drawback of push-button type dimmer units is that with minimum resistance settings, i.e., relatively high brightness settings, arcing takes place at the switch contacts when the switch is operated. This, of course, reduces the life of the contacts and causes current surges through the load which may also reduce the effective life of the load.

Rotary type switching potentiometers, on the other hand, are typically, though not always, at maximum resistance when the load is switched. They are typically operated by rotating the control knob to switch power to the device and then continuing to rotate the control knob until the desired brightness setting is reached. When it is desired to turn the unit off the control knob is rotated in the opposite direction to reduce the brightness of the load to a minimum before switching takes place. While the life of the contacts and the life of the load are thus extended it is necessary to reset the desired level of brightness each time the unit is turned on.

Rotary type switching potentiometers of the type set at minimum resistance rather than maximum resistance after switching possess the further disadvantage that arcing takes place whenever the unit is switched on since the load is thus provided with maximum current and thus a maximum brightness which may be dimmed by a further rotation of the control knob.

It would therefore be desirable and advantageous to devise a switching potentiometer control unit for light dimming and similar applications which avoids the disadvantages of both conventional push-button and rotary type switching potentiometers. Thus, it would be desirable to devise a switching potentiometer which could both be set to a desired brightness level for controlling the lamp load, that could be switched on and off without changing the brightness level such that a desired level can be maintained between operations of the switching portion of the switching potentiometer and which could assure that minimum arcing takes place at the switch contacts when the unit is turned on or off.

SUMMARY OF THE INVENTION

One object of the present invention is to provide a new and improved control unit for controlling the current delivered to a load.

A further object of the present invention is to provide a new and improved switching potentiometer control unit, for example, a dimmer circuit or the like, which can be set to a desired level of control or be switched on and off without arcing of its contacts.

A further object of the present invention is to provide a new and improved switching potentiometer control unit of the push-button type which has none of the disadvantages of prior art control units.

It is a further object of the present invention to provide a new and improved switching potentiometer control unit which features a novel snap-action switching mechanism.

A control unit for controlling the power delivered to an electrical load from a supply of electrical energy, in accordance with the principles of the present invention, may include means for connecting the unit serially between the supply and the load, switching means for selectively making and breaking the series connection, impedance means having a maximum value for determining the minimum power delivered from the supply to the load, contact means selectively engagable with and positionable on the impedance means for selectively shunting a portion of the impedance means, depending upon the position of the contact means, for increasing the power delivered from the supply to the load from the minimum value to any desired level up to a maximum value when the impedance means is completely shunted, and common actuating means coupled to both the switching means and the contact for selectively disengaging the contact from the impedance means when the switching means is actuated.

The control unit employs a novel switching potentiometer which includes a base having a resistive strip formed thereon, a shaft mounted for axial reciprocating movement and for rotational movement about its axis, a wiper mounted on the shaft, means resiliently urging the shaft toward the base to urge a portion of the wiper into engagement with the resistive strip and switching means operatively coupled to the shaft for actuation thereby when the shaft is moved away from the base whereby the wiper is disengaged from the resistive strip whenever the shaft actuates the switching means.

The switching means includes a novel snap switch comprising a movable contact mounted for pivotal movement between first and second rest positions into which it is urged by a compression means, an actuating means movable between a first axial position and a second axial position along an axis through an aperture in the movable contact, a camming member formed with the first and second circumferentially spaced radial projections thereon loosely mounted on the actuating means for imparting movement to the movable contact on alternate sides of the aperture by engaging diametrically opposite projections formed thereon, the angular distance between the radial projections on the camming member being less than the angular distance between the projections formed on movable contact and means for partially rotating the camming member about the axis of the actuating means alternately to position one of the radial projections on the camming member in alignment with the projection on the movable contact after each successive actuation of the actuating means.

The radial projections on the camming member include first and second cam portions formed at the opposite ends of each radial projection, the first cam portion being utilized to engage one side of one projection formed on the movable contact and the second cam portion being utilized to engage the other side of the same projection to impart partial rotative movement to the camming member to align the first camming means of the other radial projection with one side of the other projection to impart partial rotative movement to the camming member to align the first camming means of the other radial projection with one side of the other projection formed on the movable contact when the actuating means is returned to its initial position.

The potentiometer control unit includes a circular wiper mounted eccentrically on a shaft and bent at diametrically opposite portions to define first and second brush contacts. The brush contacts simultaneously engage a resistive strip and a conductive portion formed on the base to vary the potentiometer resistance.

BRIEF DESCRIPTION OF THE DRAWINGS

A complete understanding of the invention may be obtained from the following detailed description thereof, when read in conjunction with the accompanying drawings, wherein.

DETAILED DESCRIPTION

Figure 1:
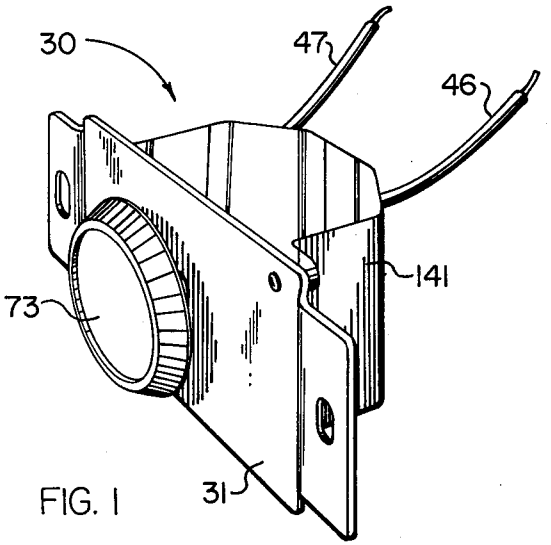
FIG. 1 is a perspective view of a control unit in accordance with the principles of the invention.

Referring to FIG. 1, there is shown a switching potentiometer control unit 30, which may be, for example, a dimmer unit for controlling a lamp load connected in series therewith and may be designed to function as both a switch for switching power to the load and a dimmer control for controlling the intensity or brightness of the load.

Figure 2:
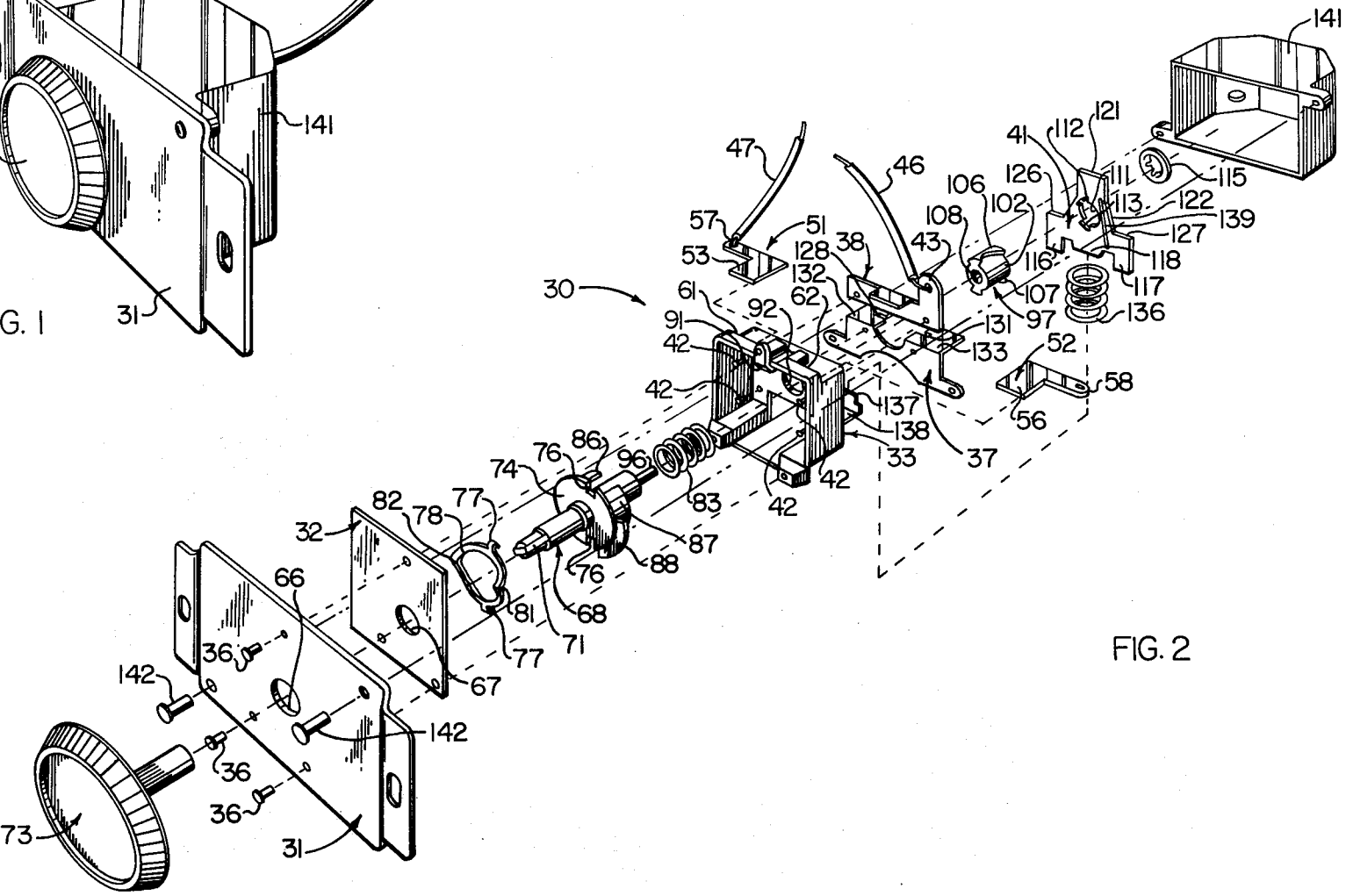
FIG. 2 is an exploded view of the control unit of FIG. 1, with certain conventional components therein removed for clarity, showing the novel construction thereof.

As shown in the exploded view of the control unit 30, in FIG. 2, the unit 30 includes a chassis 31 having a ceramic substrate 32 and a housing 33 secured thereto by a plurality of suitable fasteners such as eyelet rivets 36—36. Secured to the housing 33 is a switch bracket 37 and a switch contact 38 which may be electrically connected to one another selectively through an armature 41 which is pivotally mounted on the switch bracket 37. The bracket 37 and the contact 38 are secured to the housing 33 through suitable fastening means such as eyelet rivets 42—42. A lug 43, formed on the contact 38, is suitably soldered to the conductive core of an insulated wire 46 for connecting the unit 30 to one terminal of a suitable source of alternating current.

Another insulated wire 47, which for connecting the unit 30 to a lamp load (not shown) is soldered to a first of a pair of solder terminals 51 and 52, each being in general of an L shape, comprising elongated portions 53 and 56, respectively, extending normally from which are soldering lugs 57 and 58, respectively. The elongated portions 53 and 56 of the solder terminals 51 and 52, respectively, are inserted into a pair of spaced slots 61 and 62 formed on one side of the housing 33 with the ends of the portions 53 and 56 extending out of the slots 61 and 62 toward the ceramic substrate 32. The ends of the elongated portions 53 and 56 of the solder terminals 51 and 52 projecting from the slots 61 and 62 may be bent away from the housing 33 and suitably soldered to predetermined areas of a metalization pattern formed on the ceramic substrate 32 as will be more fully discussed below with respect to FIG. 18.

The bracket 37, the contact 38 and the armature 41 are preferably formed by being stamped from a suitable highly conductive metal, for example, copper. The solder terminals 51 and 52 are preferably formed from another suitably highly conductive metal, for example, brass or copper.

The chassis 31 and the ceramic substrate 32 are formed with aligned apertures 66 and 67, respectively, for receiving one end of a shaft or operating plunger 68 formed with a key 71 which may be seated into a suitable keyway (not shown) formed within a sleeve 72 forming part of an operating knob 73 for the unit 30. The shaft 68 is mounted for both axial reciprocating and partial rotational movement in two directions in the housing 33.

An intermediate portion of the shaft 68 is formed with a disc 74 having a pair of notches 76—76 formed on chordally opposite sides thereof for receiving a pair of tabs 77—77 formed on a circular wiper 78 disposed eccentrically over the shaft 68 and supported on the disc 74. The wiper 78, which is preferably formed from a phosphor-bronze alloy, is bent at an angle of approximately 15° along a diameter thereof to define first and second contact portions 81 and 82 thereof which act as brushes for a deposited resistance on the ceramic substrate 32 as will be understood more fully from the discussion below.

A compression spring 83 is disposed concentrically over the shaft 68 on the opposite side of the disc 74 and is received between a pair of spaced arcuate projecting guides 86 and 87 extending axially from the disc 74. An arcuate stop member 88, formed radially on one side of the disc 74, acts to limit the clockwise or counterclockwise rotary movement of the shaft 68 when the opposite sides of the stop 88 engage and elongated limiting member 91 formed in the housing 33. The portion of the shaft 68 extending past the guides 86 and 87 extends through an aperture 92 formed in the housing 33 and has formed thereon a coaxial peg 96.

The compression spring 83 engages the interior of the switch housing 33 surrounding the aperture 92 to urge the shaft 68 and the knob 73 axially in a first direction out of the apertures 66 and 67 formed in the ceramic substrate 32 and chassis 31, respectively.

A ratchet or camming cylinder 97 includes a cylindrical body 102 formed with a pair of elongated radially projecting camming elements 106 and 107 and an axial bore 108. The shaft 68, the knob 73, and the ratchet 97 are molded from suitable durable plastic material, for example, nylon.

The armature 41 is formed with a central aperture 111 formed on opposite sides of an upper portion thereof with first and second radially extending arcuate cutout sections or notches 112 and 113, respectively, for receiving the body 102 and the camming elements 106 and 107 of the ratchet 97. The ratchet 97 is freely disposed on the peg 96 of the shaft 68 which passes through the bore 108 and extends therebeyond for receiving a push-on fastener 115 to limit the axial movement of the ratchet 97 on the peg 96.

The armature 41 includes a generally E-shaped portion including first and second parallel outer legs 116 and 117 and a shorter and wider, tapered parallel inner leg 118, extending rearwardly of which is an elongated contact portion 121 which is connected thereto by a tapered section 122 which joins the E-shaped portion at first and second shoulders 126 and 127. The tapered section 122 of the armature 41 is received through first and second notches 128 and 131 formed in first and second tabs 132 and 133 respectively on the switch bracket 37.

The armature 41 is urged into the notches 128 and 131 of the switch bracket 37 by a compression spring 136 which is disposed over the middle leg 118 of the armature 41 and a lug 137 extending outwardly at a right angle from a projecting member 138 formed on the housing 33. The shoulders 126 and 127 formed on the armature 41 act as stops against the tabs 132 and 133, respectively, on the switch bracket 37.

The armature 41 may have formed therein a stamped elongated boss 139 which acts as a rib to provide stiffness to the armature 41.

The exploded view of the unit 30 shown in FIG. 2 does not include certain conventional electrical components, and connections which are necessary to the proper operation of the unit 30. This was done for purposes of clarity only and the complete unit is described fully below.

A case or cover 141 is provided to protect and seal the unit 30 and is secured to the chassis 31 through a pair of eyelet rivets 142—142. The chassis 31 may be formed from a suitable lightweight metallic material, for example, aluminum. The switch housing 33 and the cover 141 are preferably formed from a suitable thermosetting plastic material, for example, a phenolic resin.

Figure 3:
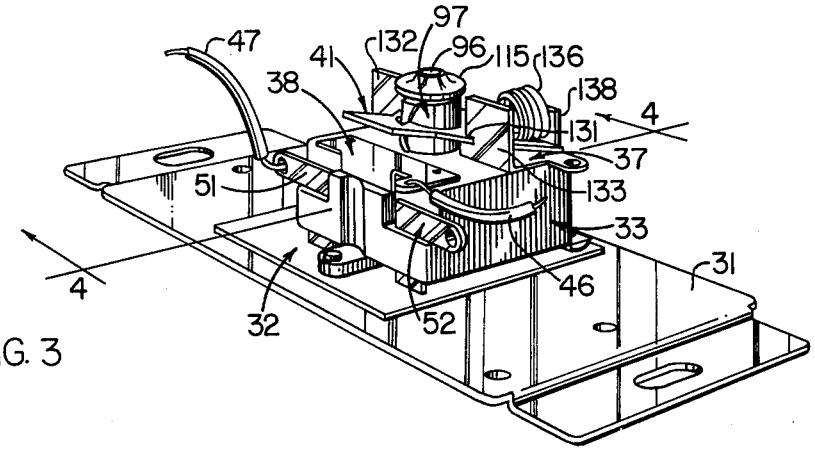
FIG. 3 is a perspective view of the unit of FIG. 2 assembled, with a cover thereon removed.

FIG. 3 shows the unit of FIG. 2 as it appears when it is assembled with the cover 141 thereon removed.

Figure 4:
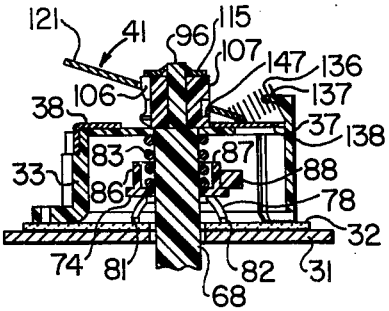
FIG. 4 is a sectional view of the unit of FIG. 3 taken along the lines of 4—4 thereof.
Figure 6:
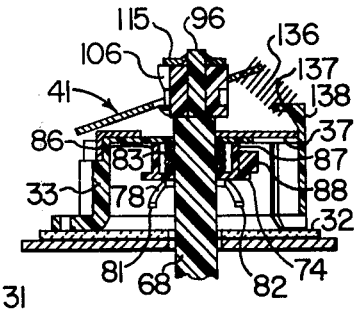
Figure 7:
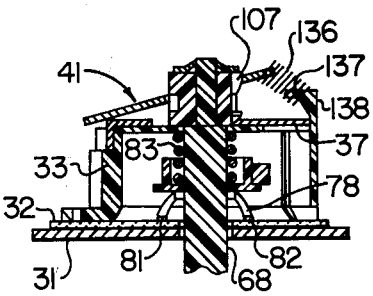

The purpose of the armature 41 is to selectively provide a conductive path between the switch bracket 37 and the switch contact 38. The armature 41 defines a movable contact of a single-pole-single-throw (SPST) switch and has two stable states or rest positions. The first stable state is shown in FIGS. 3 and 4 where the portion 121 of the armature 41 does not engage the switch contact 38. The second stable state is shown in FIGS. 6 and 7 where a conductive path between the switch bracket 37 and the switch contact 38 is provided through the armature 41 with the portion 121 of the armature 41 engaging the switch contact 38. The combination of the compression spring 136, the armature 41, the switch bracket 37, the shaft 68 and the ratchet 97 comprise a snap-action mechanism for selectively opening and closing the conductive path between the switch bracket 37 and the switch contact 38 by imparting a thrusting pivotal movement to the armature 41.

Figure 5:
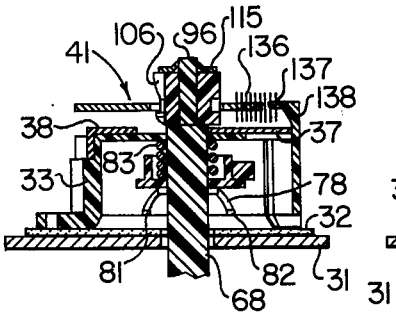
FIGS. 5, 6 and 7 are similar to FIG. 4, showing a sequence of operation of the switching portion of the unit.

FIG. 5 shows the unstable pivotal position of the armature 41 which is in a plane parallel to the surface of the housing 33 which the armature 41 assumes during maximum compression of the spring 136.

Figure 8:
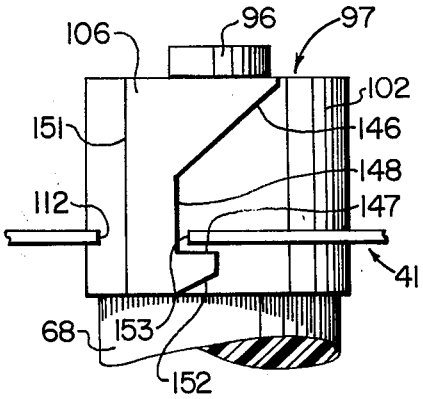
FIG. 8 is an enlarged elevational view of a novel ratchet or camming cylinder which facilitates the operation of the switching portion of the unit.
Figure 9:
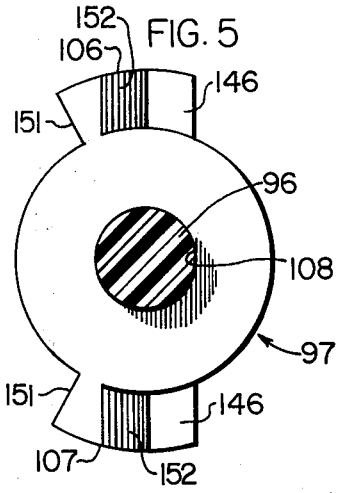
FIG. 9 is a bottom view of the ratchet of FIG. 8.

Before referring to the operation of the switching portion of the unit 30 as shown in FIGS. 4, 5, 6 and 7, the ratchet 97, which is shown in detail in FIGS. 8 and 9, should be further described in order fully to understand the operation of the switching portion of the unit 30.

Referring to FIGS. 8 and 9, each camming element 106 and 107 includes on one side a helical cam portion 146 and a shoulder 147 connected by an intermediate linear portion 148. The opposite side of each camming element 106 and 107 includes a radial face 151. The opposite side of each shoulder 147 is formed with a small cam portion 152. The camming elements 106 and 107 of the ratchet 97 impart pivotal movement to and facilitate the snap-action operation of the armature 41.

Referring once again to FIG. 4, where the switching portion of the unit 30 is in the open or unoperated position, it can be seen that the compression spring 83 urges the shaft 68 downwardly, biasing the brush contact portions 81 and 82 of the wiper 78 against the ceramic substrate 32. The rotational movement of the ratchet 97 on the peg 96 of the shaft 68 is limited by the camming elements 106 and 107 which extend through the notches 112 and 113 in the armature 41 and are constrained thereby.

Figure 10:
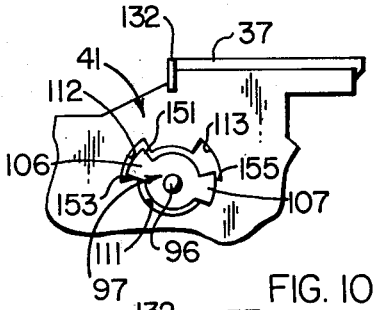
FIGS. 10 and 11 are plan views to two angular positions of the ratchet of FIGS. 8 and 9 in the control unit, corresponding to the operating positions of FIGS. 4 and 7, respectively.

The rotational angular position of the ratchet 97 relative to the notches 112 and 113 in the armature 41 when the switching portion of the unit 30 is unoperated is shown in FIG. 10. As shown in FIG. 10, the arcuate notch 112 formed in the armature 41 is slightly larger than the top face of the camming element 106 and is aligned therewith in the open position of the armature 41. (FIG. 4). Similarly, the notch 113 is slightly larger than the top face of the camming element 107 and is circumferentially spaced clockwise with respect thereto. Each of the notches 112 and 113 extends circumferentially from diametrically opposite sides of the aperture 111 formed in the armature 41 toward one another for approximately 50° around the circumference of the aperture 111. The largest circumferential portion of each camming element 106 and 107 extends around the body 102 of the ratchet 97 for approximately 48° from chordally opposite sides thereof.

In FIG. 10, the angular distance between the face 151 of the camming element 106 is advanced in the clockwise direction by approximately 30° from the forward portion 153 of the notch 112 which is aligned diametrically opposite to the forward portion 155 of the notch 113.

Referring now to FIG. 5, when the shaft 68 is moved upwardly against the force of the spring 83 the shoulder 147 on the camming element 107 engages the underside of the armature 41 adjacent to the forward portion 155 of the notch 113 where it joins the aperture 41, causing the armature 41 to pivot about an axis through the shoulders 126 and 127 (FIG. 1) from the position shown in FIG. 4 counterclockwise to the position shown in FIG. 5 to assume a horizontal orientation where it exerts maximum compression on the spring 136.

It should be noted that the wiper 78 is disengaged from the ceramic substrate 32 when the shaft 68 is moved against the force of the spring 83. At this time the shoulder 147 of each camming element 106 and 107 of the ratchet 97 is aligned in parallel with the armature 41 which is in a plane parallel to the surface of the housing 33 and spaced therefrom by a distance equal to the distance between the pivot axis defined by the shoulders 126 and 127 of the armature 41 and the notches 128 and 131 formed in the tabs 132 and 133 of the switch bracket 37. This is shown more clearly in FIG. 8 where the armature 41 is shown in phantom.

Continued movement of the shaft 68 against the force of the spring 83 causes the contact portion 121 of the armature 41 to move past the pivot axis of the armature 41 toward the upper surface of the housing 33. When this occurs the armature 41 no longer exerts maximum compression on the spring 136 and the latter impels the E-shaped end of the armature 41 counterclockwise to snap the contact portion 121 into engagement with the contact 38 to provide a conductive path between the switch bracket 37 and the contact 38. This is shown in FIG. 6. It should be noted that the arcuate guides 86 and 87 on the disc 74 of the shaft 68 act as stops against the underside of the housing 33 to limit the axial movement of the shaft 68 into the housing 33. At this time the angular position of the ratchet 97 is unchanged from its initial position, shown best in FIG. 10.

Figure 11:
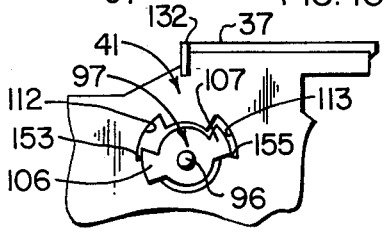

When the shaft 68 is thereafter released, the spring 83 again urges it downwardly. At this time, the upper side of the armature 41 adjacent to the forward portion 155 of the notch 113, which is adjacent to the cam portion 146 of the camming element 107 is engaged thereby, rotating the ratchet 97 approximately 30° counterclockwise about the axis of the shaft 68 as it is moved downwardly from the position shown in FIG. 6 to the position shown in FIG. 7 where the ratchet 97 assumes the angular position shown in FIG. 11.

Thus when the armature 41 is snapped from the open position shown in FIG. 4 to the closed position shown in FIGS. 6 and 7 to establish electrical contact between the switch bracket 37 and the switch contact 38, and the shaft 68 is released, as shown in FIG. 7, the ratchet 97 rotated approximately 30° counterclockwise to align the shoulder 147 of the camming element 106 with the underside of the armature 41 adjacent to the forward edge 153 of the notch 112 therein.

As shown in FIGS. 4 and 7, when the shaft 68 is released and is urged downwardly by the spring 83, the wiper 78 is again urged against the ceramic substrate 32 with the brush contact portions 81 and 82 thereof resiliently engaging the ceramic substrate 32.

If it is desired to switch the armature 41 from the closed position in FIG. 7 to the open position shown in FIG. 4, the shaft 68 must again be depressed or forced against the biasing action of the spring 83 to snap the armature 41 from the position shown in FIG. 7 to the position shown in FIG. 4. In this subsequent or reverse operation, the shoulder 147 of the camming element 106 engages the underside of the armature 41 adjacent to the forward edge 155 of the notch 112 moving the armature 41 upwardly to the horizontal position shown in FIG. 5 which is the position of maximum compression on the spring 136. Continued movement of the shaft 68 against the force of the spring 83 causes the spring 136 to impel the E-shaped portion of the armature 41 clockwise such that the contact portion 121 of the armature 41 is snapped into the open position shown in FIG. 4 and the legs 116 and 117 (FIG. 1) of the armature 41 are snapped into engagement with the rearward portion of the switch bracket 37.

When the shaft 68 is forced upwardly against the spring 83, the wiper 78 is again disengaged from the ceramic substrate 32. After the snap takes place and the shaft 68 is released, permitting the spring 83 to force it downwardly, the brush contact portions 81 and 82 of the wiper 78 again are resiliently biased against the ceramic substrate 32. Also the cam portion 146 of the camming element 106 engages the forward portion 153 of the notch 112 of armature 41 to rotate the ratchet 97 30° in the clockwise direction to assume the position shown in FIGS. 4 and 10, realigning the shoulder 147 of the camming element 107 with the forward portion 155 of the notch 113.

Thus it can be seen that for each operation of the switching portion of the unit 30, wherein the armature 41 is snapped between the open or first stable position shown in FIG. 4 and the closed or second stable position shown in FIG. 7, the ratchet 97 is rotated 30° in opposite directions during alternate operations of the shaft 68. This alternately aligns the shoulder 147 of each camming element 106 and 107 for subsequent snap-actuation of the armature 41. The helical cam portions 146 of the camming elements 106 and 107 and the manner in which they cooperate with the notches 112 and 113 in the armature 41 provide this self-cocking capability. The switching portion of the unit 30 is therefore a reciprocating (push-push) switch which is opened and closed by alternately depressing and releasing the shaft 68. The depression of shaft 68 operates the switch while the release of the shaft 68 cocks the actuating ratchet 97 for a subsequent operation. Each time the shaft 68 is depressed, for example, by pushing the knob 73 toward the chassis 31, the wiper 78 carried by the shaft 68 is disengaged from the ceramic substrate 32.

Referring once again to FIGS. 8 and 9, attention is directed to the small cam portions 152 of the camming elements 106 and 107. The shaft 68 may be depressed until the arcuate guides 86 and 87 thereon engage the underside of the housing 33 as shown in FIG. 6 such that the entire longitudinal extent of either of the camming elements 106 and 107 project axially beyond notches 112 and 113 in the aperture 111 formed in the armature 41. The lowermost portion of the projecting camming element may be turned slightly, for example, by an external spurious vibration or by rotating the shaft 68 while it is being depressed. The slight play in the ratchet 97 with respect to the armature might cause the projecting element to overlie its associated notch 112 or 113 formed in the armature 41. In such a case, subsequent release of the shaft 68 permits the small cam face 152 of either camming element 107 or 108 to engage the forward portions 153 or 155, respectively, of the notches 112 or 113 of the armature 41 to impart either clockwise or counterclockwise initial rotational movement to the ratchet 97 to prevent the ratchet 97 from becoming hung up on the armature 41 as it might if the small camming surface 152 were horizontal instead of inclined as shown in FIG. 8. This insures that the switching portion of control unit 30 will operate without binding or sticking.

Thus the control unit 30 is provided with a simple and reliable snap-action mechanism which includes the shaft 68, the spring 83, the housing 33, the ratchet 97, the switch bracket 37 and the armature 41. The armature 41, the switch contact 38 and the bracket 37 define a single-pole-single-throw switching arrangement for the unit 30. As shown in FIGS. 8 and 9, the widest portions of the lower faces of the camming elements 106 and 107 between the faces 151 and the small cam surfaces 152 may extend approximately 15° around the peripheral surface of the body 102 of the ratchet 97. Each helical cam surface 146 is at approximately a 45° helical angle to the face 151 of the body 102 of the ratchet 97. The small cam face 152 is at a helical angle of approximately 60° to the face 151 of each camming element 106 or 107 of the ratchet 97. The axial length of the ratchet 97 may be approximately one-quarter inches and the connecting portion 148 of each camming element 106 and 107, which connects the cam portion 146 with the shoulder 147 formed thereon, may have a width of approximately 135 mils. The diameter of the body 102 of the ratchet 97 may be approximately 300 mils, with the diameter of the bore 108 formed therethrough by approximately 130 mils, slightly larger than the diameter of the peg 96.

Figure 13:
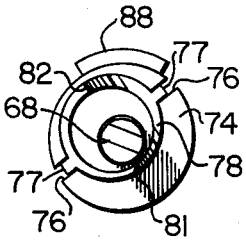
FIG. 13 is an end view of the shaft and wiper of FIG. 12.
Figure 12:
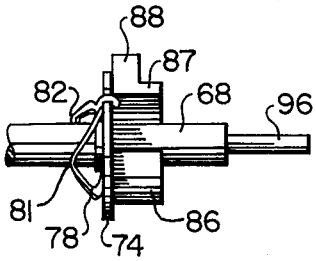
FIG. 12 is an enlarged view of a portion of an operating plunger or shaft and the manner in which a novel wiper is secured thereto, comprising part of a potentiometer in the unit.

Referring to FIGS. 12 and 13, the manner in which the wiper 78 is secured to the shaft 68 is shown in more detail. As mentioned previously, the wiper 78 has a circular or annular shape and is formed with diametrically opposite tabs 77—77. The wiper 78 is bent at diametrically opposite sides thereof which are rotated centrally of the tabs 77—77, forming two dihedral angles of approximately 150°, the opposite sides of which define the brush contact portions 81 and 82.

As shown in FIG. 13 the wiper 78 is mounted eccentrically on the shaft 68 with the brush portion 81 on the wiper 78 being closer to the center of the shaft 68 than the brush portion 82 formed on the wiper 78. The tabs 77—77 are received in the chordally opposed notches 76—76 formed on the coaxial disk 74 of the shaft 68.

Figure 14:
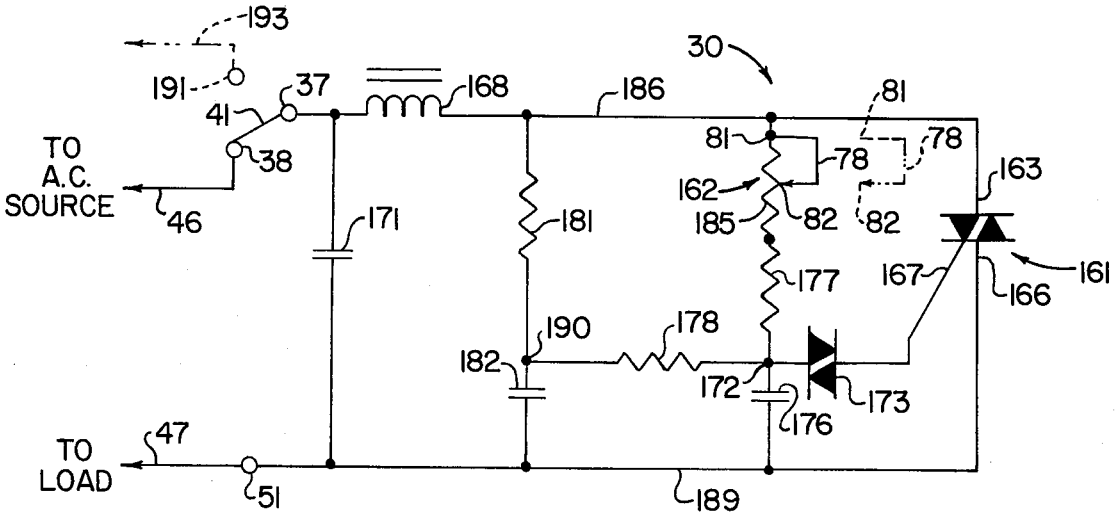
FIG. 14 is an electrical schematic diagram of the circuit of the control unit.

Referring to FIG. 14, there is shown an electrical schematic diagram of the complete control unit 30. The insulated wires 46 and 47 are connected respectively to the switch contact 38 and the solder terminal 51 shown in FIG. 1. This places the control unit 30 in series with the load to be controlled, which may be, for example, one or more incandescent lamps when the control unit 30 is to be used as a light dimmer. The armature 41 is shown as a movable contact for a single-pole-single-throw switch for establishing a connection between the switch bracket 37, shown as one switch contact, and the switch contact 38 to supply current to the circuit of FIG. 14. The control circuit shown in FIG. 14 is a conventional current control circuit for controlling the delay firing angle of a bilateral semiconductor triode (triac) 161.

The delay firing angle of the triac 161 is controlled by varying a potentiometer 162 by adjusting the position of the wiper 78 thereon. As mentioned previously, the wiper 78 is secured to the disc 74 of the shaft 68 such that rotation of the shaft 68 positions the brush portion 82 of the wiper 78 along the resistive portion of the potentiometer 162 which is formed on the ceramic substrate 32. The triac 161 includes a pair of power electrodes 163 and 166 and a gate electrode 167. The electrode 163 of the triac 161 is connected to the switch bracket 37 through a choke 168. A capacitor 171 is connected across the input of the circuit between the armature 41 and the supply line 47. The choke 168 and capacitor 171 comprise an RF filter for the circuit. The electrode 166 of the triac 161 is electrically connected to the terminal 51. The gate 167 of the triac 161 is connected to a terminal 172 through a bilateral semiconductor diode (diac) 173. A capacitor 176 is connected between the terminal 172 and the terminal 51. A resistor 177 is connected between the potentiometer 162 and the terminal 172. A resistor 178 is connected between a resistor 181 and a capacitor 182 connected in series between the other side of the choke 168 and the terminal 51.

In operation, when the armature 41 is actuated to close the circuit path between the switch bracket 37 and the switch contact 38 the line voltage is applied to the circuit of FIG. 14 and its load through the wires 46 and 47. The capacitor 176 charges until the charge thereon exceeds the breakover voltage of the diac 173. This occurs sometime before the peak of the line voltage, which is shown in FIG. 15*a*. When the diac 173 breaks over, the triac 161 is caused to conduct through the remaining portion of the half cycle of line voltage. The time it takes the capacitor 176 to charge up to the breakover voltage of the diac 173 is controlled by the combination of the resistances 162, 177, 178 and 181 and the value of the capacitors 176 and 182. Thus the adjustment of the potentiometer 162 controls the delay firing angle of the triac 161 to provide phase retardation thereto.

When the shaft 68 is depressed to cause the line voltage to be applied to the circuit of FIG. 14, the wiper 78 is disengaged from the resistive portion 185 of the potentiometer 162 as shown in FIGS. 5 and 6 and in phantom in FIG. 14. This applies maximum phase retardation to the triac 161 since the entire resistive portion 185 of the potentiometer 162 is included in the circuit at that time. When the shaft 68 is again released to permit the spring 83 to bias the shaft 68 and the wiper 78 against the ceramic substrate 32, where the resistive portion 185 of the potentiometer 162 is formed, the phase retardation on the triac 161 may change depending upon the position of the brush portion 82 of the wiper 78, i.e., the rotative position of the shaft 68 which is controlled by the knob 73.

Thus, when the shaft 68 is initially depressed the armature 41 snaps from the position shown in FIG. 4 to the position shown in FIG. 6 to apply voltage to the circuit of FIG. 14 while the wiper 78 is disengaged from the ceramic substrate 32 with the resistive portion 185 of the potentiometer 162 is formed. The voltage across the triac 161 at this time is shown in FIG. 15*b*. As shown in 15*b*, when maximum phase retardation is applied to the triac 161, it conducts for a very small portion of each half cycle of line voltage. This is shown as being approximately 10% conduction during each half cycle of operation. This will cause a very small current to be applied to the load which is in series with the circuit of FIG. 14.

When the shaft 68 is released to permit the spring 83 once again to urge the wiper 78 against the ceramic substrate 32, the brush portion 82 of the wiper 78 engages the resistive portion 185 of the potentiometer 162 formed on the substrate 32 to change the phase retardation applied to the triac 161, depending upon the rotative position of the shaft 68. This is shown in FIG. 15*c* where the phase retardation applied is shown as being approximately 40%. Thus the triac 161 conducts for a longer period, approximately 60%, during each half cycle of applied voltage and delivers more current to the load. If the load is a lamp, the result of the above is that the lamp will initially come on and glow very dimly when the shaft 68 is initially depressed and the armature 41 snaps into its closed position and will glow brighter when the shaft 68 is released depending upon the position of the shaft 68 and the wiper 78. If the shaft 68 were set to the extreme counterclockwise position, release of the shaft 68 after its initial depression and snap-over of the armature 41 would cause little or no change. This is because the extreme counterclockwise position of the shaft 68 places the brush portion 82 of wiper 78 to include the entire resistive portion 185 of the potentiometer 162 in the circuit for maximum phase retardation.

Thereafter, the phase retardation of the triac 161 can be adjusted by rotating the knob 73 coupled to the shaft 68 to adjust the brightness or intensity of the load. The brightness may be adjusted until practically no phase retardation is applied to the triac 161 such as when the brush portion 82 of the wiper 78 is positioned in the extreme clockwise position to essentially shunt out the resistive portion 185 of the potentiometer 162. The triac 161 would thus conduct for practically each entire half cycle of applied line voltage. This is shown in FIG. 15*d*.

If the potentiometer 162 were set by rotation of the knob 73 to produce maximum brightness of the lamp by adjusting the brush contact portion 82 of the wiper 78 to shunt out the entire resistive portion 185 of the potentiometer 162, the circuit may be opened without any substantial arcing between the armature 41 and the switch contact 38 as occurs in most push-button operated dimmer units. This is because the wiper 78 is disconnected from the resistive portion of the potentiometer 162 before any switching takes place regardless of whether the unit is being switched on or off.

Thus, before any switching takes place maximum phase retardation is applied to the triac 161 to reduce the current through the load to a minimum. When the current through the load and thus through the circuit 14 is at a minimum, switching can take place without any substantial arcing, thus assuring longer life to the switch contact 38 and the armature 41 and preventing substantial current surges through the load. Thus the control unit 30 possesses the advantages of prior art rotary and prior art push-button dimmer units with none of the disadvantages of either.

Figure 15:
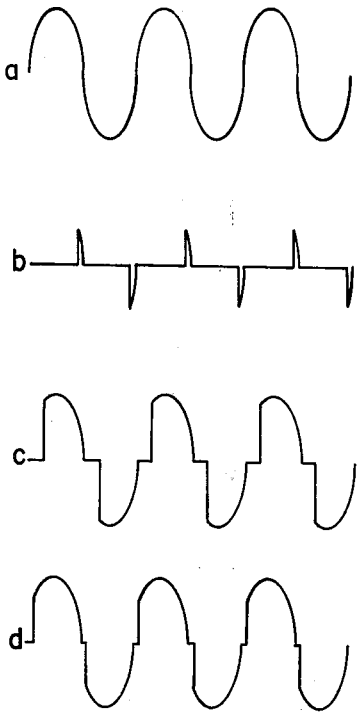
FIG. 15 illustrates various wave forms helpful in understanding the circuit of FIG. 14.
Figure 16:
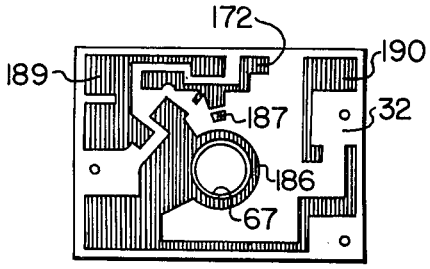
FIG. 16 shows a ceramic substrate having a metalization pattern thereon.

FIG. 16 shows the ceramic substrate 32 with a metalized pattern deposited thereon in a conventional manner, for example, by a screening or other suitable technique. As shown in FIG. 16, an annular portion 186 of the metalized pattern thereon surrounding the aperture 67 therein is that portion of the pattern which is engaged by the brush contact portion 81 of the wiper 77 when it is biased against the ceramic substrate 32. The portion 172 of the metalized pattern represents the terminal 172 shown in FIG. 14. Between the metalized portions 186 and 172 of the pattern shown in FIG. 15 is a small metalized portion 187.

Figure 17:
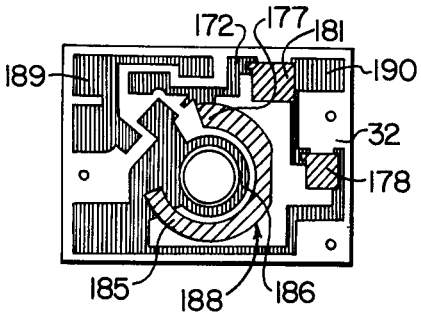
FIG. 17 shows the metalized substrate of FIG. 15 having a plurality of screened resistors deposited thereon.

FIG. 17 shows three deposited resistances representing the resistors 177, 178, 181 and the resistive portion 185 of the potentiometer 162 shown in FIG. 14. The resistive portion 185 of the potentiometer 162 and the resistor 177 are formed from a single deposited resistance 188. The resistor 177 is that portion of the deposited resistance 188 between the metalized portions 172 and 187 shown in FIG. 16. The remainder of the deposited resistance 188 is the resistive portion 185 of the potentiometer 162, which is engaged by the brush portion 82 of the wiper 78.

Figure 18:
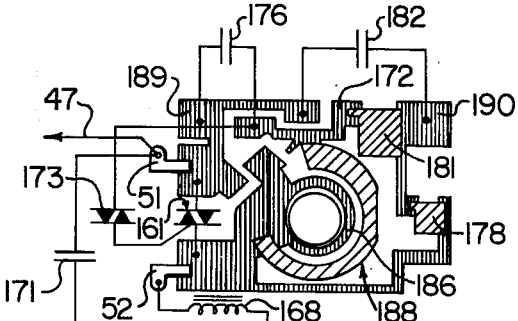
FIG. 18 shows the substrate of FIG. 17 and the manner in which various components, shown schematically, are attached thereto to produce the circuit of FIG. 14.

FIG. 18 shows the metallized portions without the ceramic substrate 32 and the resistances deposited thereon together with the other components shown in the circuit of FIG. 14 schematically represented. Each land area of the metalization pattern is also indicated in FIG. 14. The circuit components can occupy a relatively small space, since the ceramic substrate may be relatively small, approximately 1.5 inches by 1.25 inches. FIG. 18 also includes the solder terminals 51 and 52, the switch bracket 37, the armature 41, the switch contact 38 and the manner in which the supply wires 46 and 47 are connected into the unit 30.

Heretofore, the unit 30 has been described as including a single-pole-single-throw switch which is suitable for most applications. In dimmer units, however, it may be desirable to provide the unit 30 with another terminal such that it can be connected into a conventional three-way switching arrangement wherein three lines are connected to the unit 30 to provide three-way switching. This can be done by the alternative embodiment of the unit 30 shown in FIGS. 19 and 20 and shown schematically in FIG. 14.

Figure 19:
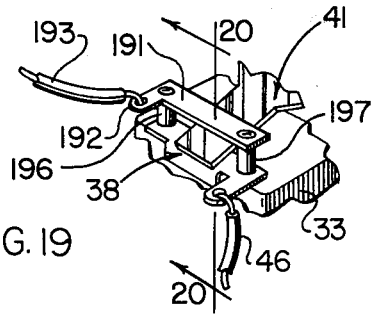
FIG. 19 is a fragmentary perspective view of an alternative embodiment of the control unit of the invention, for use in a three-way switching arrangement.
Figure 20:
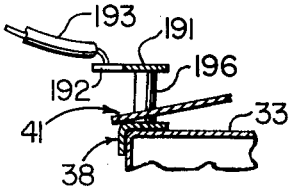
FIG. 20 is a sectional view, taken along the lines of 20—20 of FIG. 19.

As shown in FIG. 19 a second switch contact 191 having a lug 192 formed thereon for connecting to an insulated conductor wire 193 is aligned in complementary relationship to and spaced from the switch contact 38 by first and second insulating spacers 196 and 197. This arrangement permits the armature 41 to be snapped from a first position in engagement with the switch contact 38 to a second position into engagement with the switch contact 191. Thus instead of switching between a closed and an open position the armature 41 switches between the two closed positions, the first of which establishes a conductive path between the switch bracket 37 and the switch contact 38, as shown in solid lines in FIG. 14, and a second position establishing a conductive path between the switch bracket 37 and the switch contact 191, as shown in phantom in FIG. 14. The latter contact will occur when the armature 41 is positioned as shown in FIG. 4.

Though the invention has been shown and described as being particularly suitable for application in light dimming units, it can be used for other control purposes and various modifications will be obvious to those having ordinary skill in the art without departing from the spirit and scope of the invention as defined in annexed claims.

What is claimed is:

1. A switching potentiometer which comprises:
a planar base having a resistive strip formed thereon;
a shaft;
means mounting said shaft with its axis normal to said base for axial reciprocating movement and for rotational movement about said axis;
a wiper contact;
means mounting said wiper contact on said shaft;
resilient means for urging said shaft in a first axial direction to urge said wiper contact into engagement with said resistive strip; and
switching means responsive to the movement of said shaft in a second axial direction against the urging of said resilient means for a predetermined distance sufficient to disengage said wiper contact from said resistive strip.

2. A switching potentiometer as set forth in claim 1 wherein said resistive strip is arcuate and said axis passes through the center of curvature of said arcuate resistive strip.

3. A switching potentiometer as set forth in claim 2 wherein said planar base is formed with an aperture at the center of curvature of said resistive strip and said shaft is passed through said aperture.

4. A switching potentiometer as set forth in claim 3 wherein said wiper contact comprises an annular strip of highly conductive metallic material bent at diametrically opposite sides thereof to define first and second diametrically opposite dihedral angular portions the opposite sides of which define first and second brush contact portions.

5. A switching potentiometer as set forth in claim 4 and including means for mounting said wiper contact eccentrically with respect to said shaft.

6. A switching potentiometer as set forth in claim 5 wherein said wiper contact includes first and second diametrically opposite tab portions formed on said annular strip on a line rotated approximately 90° from said angular portions and said wiper mounting means includes a disc formed with first and second chordally opposed notches for receiving said tabs.

7. In a potentiometer,
a non-conductive planar base having a resistive strip formed thereon,
a shaft,
means mounting said shaft for rotation with its axis normal to said base,
a wiper contact including an annular strip of highly conductive metallic material bent at diametrically opposite sides thereof to define first and second diametrically opposed dihedral angular portions, the opposite sides of which define first and second brush contact portions, and
means mounting said wiper contact on said shaft with said brush contact portions facing said base.

8. The combination of claim 7 wherein said wiper contact is mounted eccentrically with respect to said shaft.

9. The combination of claim 8 wherein said wiper contact includes first and second diametrically opposed tab portions formed in said annular strip on a line rotated approximately 90° from said angular portions and said wiper mounting means includes means for receiving said tabs.

10. The combination of claim 9 wherein said wiper mounting means includes a disc concentric with respect to said shaft and formed with first and second chordally opposed notches for receiving said tab portions.

11. In a control unit for controlling the power delivered to an electrical load from a supply of electrical energy,
means for connecting the unit serially between the supply and the load,
switching means for selectively making and breaking said series connection,
impedance means having a maximum value for determining the minimum power delivered from the supply to the load when the switching means is actuated selectively to make the series connection,
movable contact means selectively engagable with and rotatively positionable on said impedance means for selectively shunting a portion of said impedance means for varying the power delivered from the supply to the load, and
common actuating means coupled to both said switching means and said movable contact for selectively disengaging said movable contact from said impedance means prior to operating said switching means without altering the rotative position of said movable contact means.

12. A snap action switching mechanism which comprises:
an insulating housing having a supporting surface formed with an aperture therethrough;
first and second spaced conductive elements supported on said surface on opposite sides of said aperture;
an elongated conductive member formed with an aperture therethrough having first and second longitudinally spaced, inwardly projecting portions;
means mounting said elongated conductive member in electrical contact with said first conductive element for pivotal movement about an axis in a plane spaced from said surface with said apertures aligned with one another;
first resilient means interposed between one end of said elongated conductive member and a point in said plane spaced therefrom for selectively thrusting the opposite end of said elongated member into a first pivotal rest position in engagement with said second conductive element when said one end of said elongated conductive member is moved away from said surface past said plane, and into a second pivotal rest position disengaged from said second conductive element when said opposite end of said elongated conductive member is moved away from said surface past said plane;
a shaft mounted for axial movement along an axis through said aligned apertures between a first position and a second position;
second resilient means urging said shaft into said second position;

a cylindrical camming member formed with first and second circumferentially spaced radial projections thereon;

means loosely mounting said camming member on said shaft with said first radial projection aligned for engagement with said first projecting portion of said aperture in said elongated conductive member when said opposite end of said elongated conductive member is in said first pivotal rest position to move said opposite end of said elongated conductive member away from said base past said plane to thrust said opposite end of said elongated conductive member into said second pivotal rest position when said shaft is moved from said second position to said first position, and with said second radial projection aligned for engagement with said second projecting portion of said aperture in said elongated conductive member when said opposite end of said elongated conductive member is in said second pivotal rest position to move said one end of said elongated conductive member away from said base past said plane to thrust said opposite end of said elongated conductive member into said first pivotal rest position when said shaft is moved from said second position to said first position; and means for partially rotating said camming member about the axis of the said shaft when said shaft is moved from said first position to said second position, in a first direction to align said second radial projection for engagement with said second projecting portion of said aperture in said elongated conductive member when said opposite end of said elongated conductive member is in said second pivotal rest position, and in a second opposite direction to align said first radial projection for engagement with said first projecting portion of said aperture in said elongated conductive member when said opposite end of said elongated conductive member is in said first pivotal rest position.

13. A snap action switching mechanism as set forth in claim 12 and including first and second helical cam means formed on said cylindrical camming element in longitudinally spaced relationship to said first and second radial projections, respectively, for engagement with said first and second projecting portions, respectively, of said aperture in said elongated conductive member, for imparting said partial rotational movement in said first and second directions, respectively, to said camming member when said shaft is moved from said first position to said second position.

* * * * *